United States Patent [19]

Wu

[11] Patent Number: 5,029,727

[45] Date of Patent: Jul. 9, 1991

[54] TOOTH-PICK DISENSER

[76] Inventor: Ching K. Wu, Room 2, 11th Fl., No. 85, Shoei-Yuan Road, Taipei, Taiwan

[21] Appl. No.: 597,165

[22] Filed: Oct. 15, 1990

[30] Foreign Application Priority Data

May 31, 1990 [JP] Japan ..... 2-57819

[51] Int. Cl.[5] ..... B65H 3/00

[52] U.S. Cl. ..... 221/192; 221/202; 221/254; 221/271

[58] Field of Search ..... 221/192, 200, 202, 204, 221/205, 239, 254, 255, 268, 271, 276, 311

[56] References Cited

U.S. PATENT DOCUMENTS

| | | | |
|---|---|---|---|
| 1,461,981 | 7/1923 | Newman | 221/204 |
| 2,895,638 | 7/1959 | White | 221/254 X |
| 3,938,701 | 2/1986 | Jones | 221/202 X |

FOREIGN PATENT DOCUMENTS

| | | | |
|---|---|---|---|
| 2131770 | 6/1984 | United Kingdom | 221/202 |

*Primary Examiner*—David H. Bollinger
*Attorney, Agent, or Firm*—Bacon & Thomas

[57] ABSTRACT

A tooth-pick dispenser includes a housing having a top formed with a first opening for filling tooth-picks into a tooth-pick chamber and an elongated delivery opening, a floor-like member serving as a bottom of the tooth-pick chamber and supported in the housing to inclined substantially towards the delivery opening of the top of the housing and terminated with an groove locating an elongated opening vertically in alignment with the delivery opening and an oscillation member pivotally mounted in the housing in a rotatable state, whereby the oscillation member can be swung to a feeding position allowing tooth-picks loaded in the tooth-pick chamber to movve along the inclined bottom so as to feed tooth-pick, one tooth-pick at a time, into the groove of the floor-like member and the oscillation member will be automatically retracted by a spring for discharging a tooth-pick through the delivery opening and serving it to a user in a convenient position.

1 Claim, 4 Drawing Sheets

TOOTH-PICK DISENSER

BACKGROUND OF THE INVENTION

This invention relates to a tooth-pick dispensing device.

A known tooth-pick dispenser, as shown in FIG. 1, comprises a cylindrical receptacle 10 for accommodating a plurality of tooth-picks, a sleeve member 11 is circumferentially mounted on an upper portion of the receptacle, a plate or film having a first opening 110 is provided for sealing top opening (not shown) of the receptacle 10. A cap 12 having a second opening 120 is rotatably mounted on the sleeve member 11 over the plate or film. In operation, the cap 12 should be turned to its take-out position where the first and second openings 110, 120 are in vertically aligned relation, tooth-picks can thus be taken out through the openings 110, 120 by pouring the receptacle 10.

The dispensation of tooth-picks from this known dispenser is unsatisfactory as tooth-picks may be stuck in the small opening 110 or accidentally drop to floor in taking-out operation.

SUMMARY OF THE INVENTION

It is an object of the present invention to provide a tooth-pick dispenser which is compact in construction and elegant in appearance and suitable for locating on a dining table.

It is another object of the present invention to provide a tooth-pick dispenser of this nature which is sturdy and durable in construction, reliable and efficient in operation, and relatively simple and inexpensive to manufacture and assemble.

The above and further objects, features and advantages of the present invention will become more obvious from the following description of a preferred embodiment thereof, taken in conjunction with the drawings.

DETAILED DESCRIPTION OF THE PREFERRED EMBODIMENT

Figure 1:
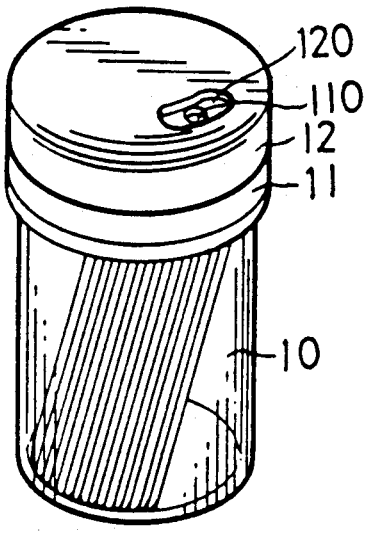
PRIOR ART FIG. 1
FIG. 1 is a perspective view of a conventional tooth-pick dispenser.
Figure 2:
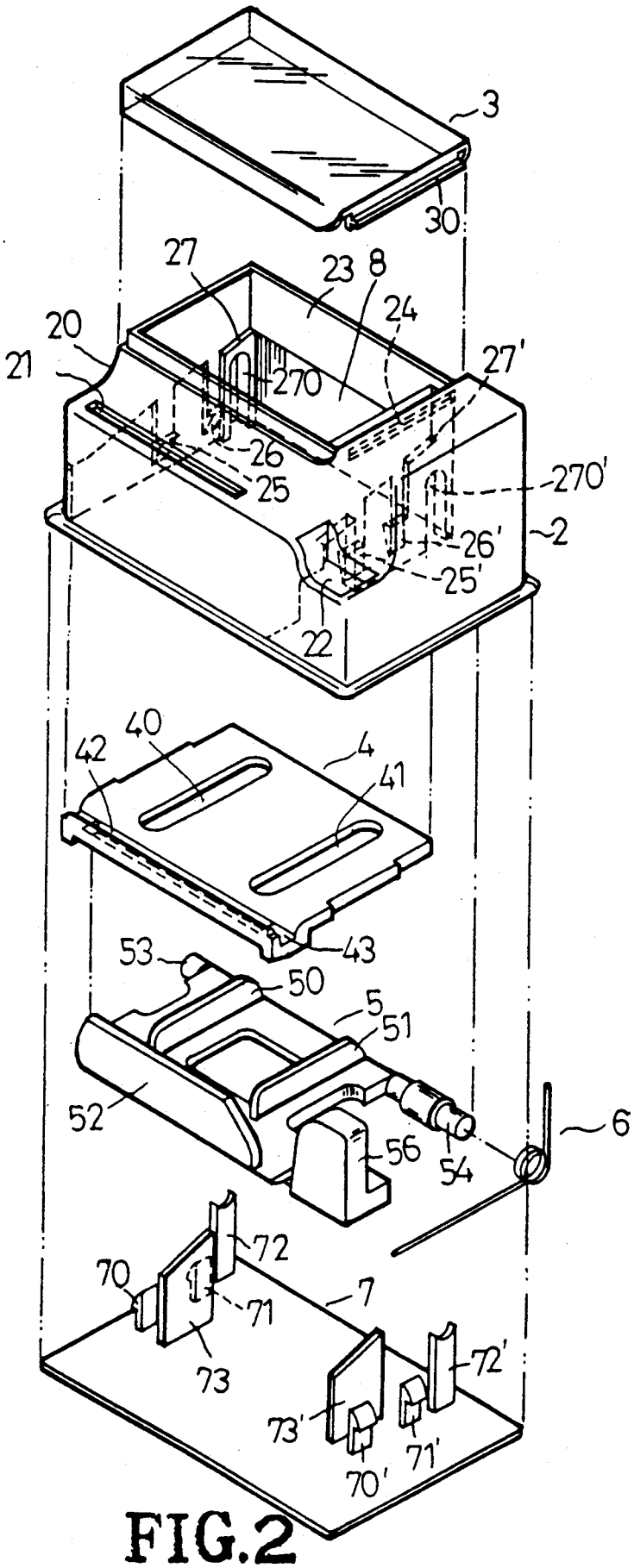
FIG. 2 is an exploded perspective view of a preferred embodiment of a tooth-pick dispenser according to the present invention.
Figure 3:
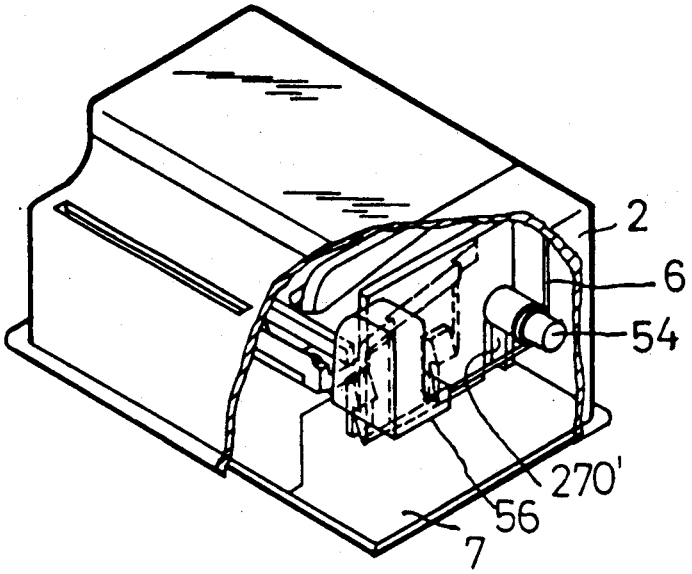
FIG. 3 is a perspective and partially broken view of the tooth-pick dispenser shown in FIG. 2.
Figure 4:
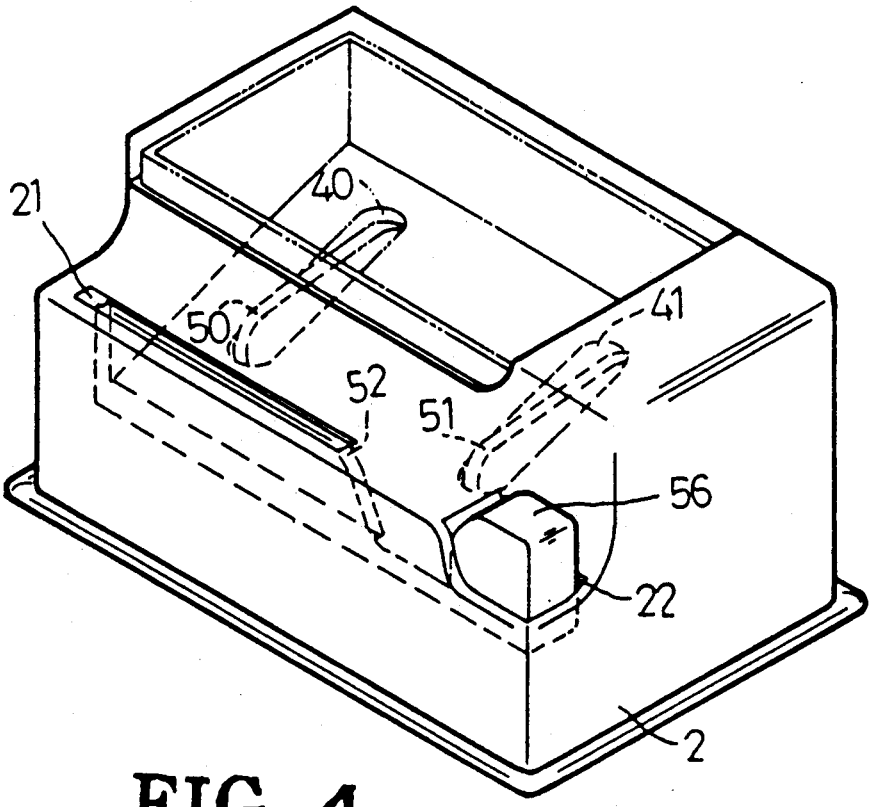
FIG. 4 is a perspective view of the tooth-pick dispenser of the present invention.

Referring now to FIGS. 2, 3 and 4, a tooth-pick dispenser according to the present invention mainly comprises a housing 2, a floor-like member 4, an oscillation member 5, a coil spring 6 and a base 7.

The housing 2 includes a top having a rectangular filling opening 23, a lid 3 for closing the filling opening 23, a front margin 20 formed with a transverse delivery opening 21 and a cut-off portion in a corner, and an open bottom. A tooth-pick chamber 8 having the rectangular filling opening is defined by two pairs of opposed vertical side walls for accommodating tooth-picks. A transverse slot 24 is formed in a vertical side wall close to the filling opening 23 for receiving a rib 30 formed on one side of the lid 3 so that the lid 3 can be secured to the housing 2 and oscillated between a closed position and an open position relative to the filling opening 23. An opening 22 communicating interior of the housing 2 is formed in the cut-off portion.

Within a pair of opposed vertical side walls, there are provided with two pairs of opposed barb-like projections 25, 25', 26, 26' and a pair of opposed brackets 27, 27' having respective inclined tops and tunnels 270, 270' having concave or semi-circular tops. The floor-like member 4 is disposed in the housing 2 and formed with two spaced slots 40, 41 extending longitudinally and a transverse groove 43 locating a slot 42 in the front end of the member 4.

The oscillation member 5 has two opposed cylindrical posts 53, 54 extending transversely and outwardly from a rear end portion to serve as an axle of the member 5. The axle posts 53, 54 are dimensioned to be mounted in the tunnels 270, 270' of the brackets 27, 27', a bent front end having an actuating plate 52 being dimensioned to extend through the openings 42, 21, a stud 56 being dimensioned to extend through the opening 22 in the cut-off portion and a pair of spaced-apart projections 50, 51 extending longitudinally and dimensioned to be able to extend through the longitudinal slots 40, 41 of the floor-like member 4.

The coil spring 6 has an intermediate eye for sleeving on the axle 54 and two legs angularly 90 degrees apart. On top surface of the base 7, there is a first pair of opposed supports 72, 72' having concave tops coacting with concave or semi-circular tops of the tunnels 270, 270' to confine the axle posts 53, 54 in a rotatable state, a second pair of opposed supports 73, 73' coacting with brackets 27, 27' to support the floor-like member 4 in a longitudinally inclined state and two pairs of opposed barb-like projections 70, 70', 71 and 71' interengageable in a snap-fitting manner to secure the base 7 to the housing 2.

In assembly, the floor-like member 4 serves as a bottom of the tooth-pick chamber 8 in the housing and slopes downwardly from a rear side wall of the housing 2 to a front side wall of the housing 2 with its transverse slot 42 vertically in alignment with the delivery opening 21. The axle posts 53, 54 is rotatably mounted between the concave tops of the supports 72, 72' and the tunnels 270, 270', bottom of the stud 56 is rested on a horizontally-extended leg of the spring 6 so as to maintain the oscillation member normally in a horizontal position where the actuating plate 52 in the front end extending through the transverse slot 42 of the floor-like member 5.

Figure 5:
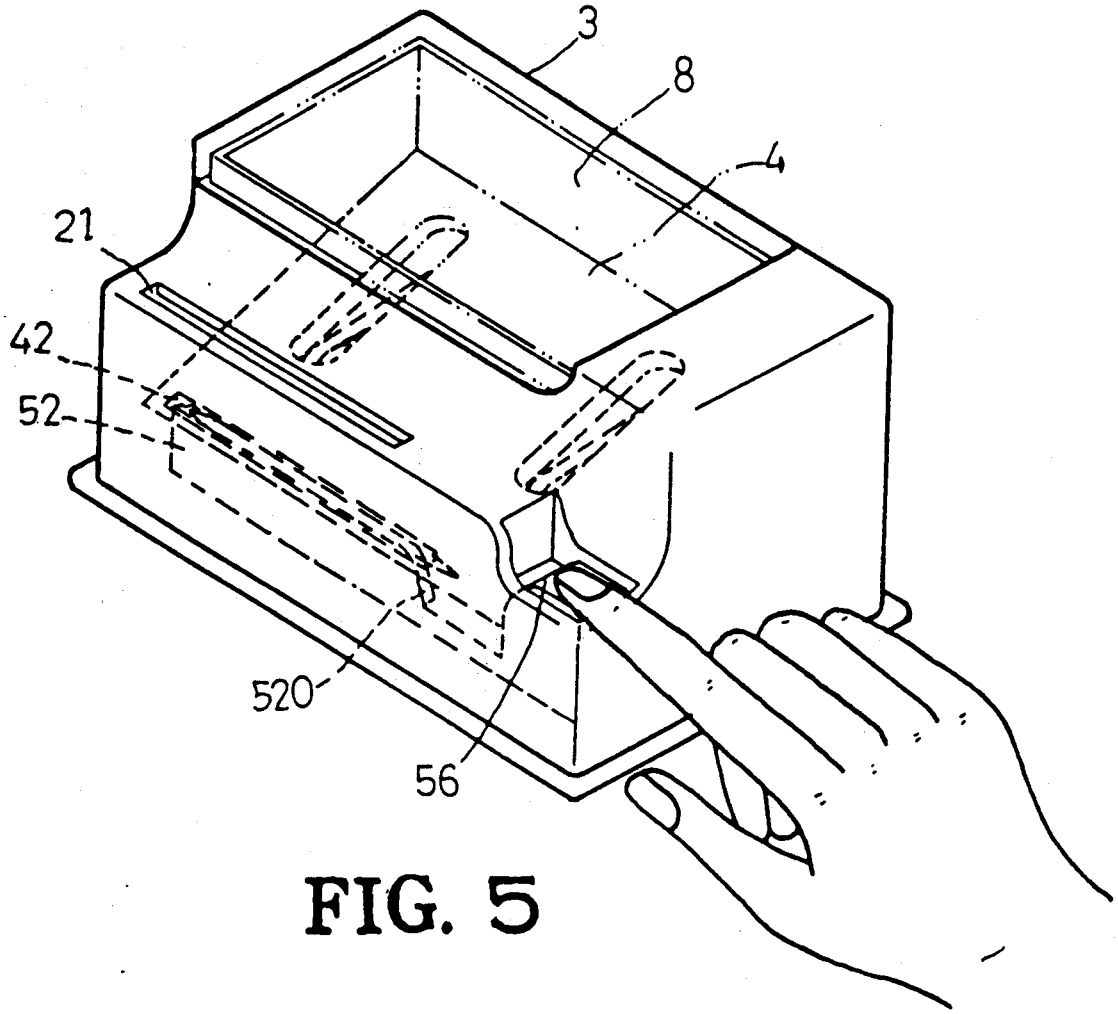
FIG. 5 is a perspective view showing the dispensing operation of the tooth-pick dispenser of the present invention.
Figure 6:
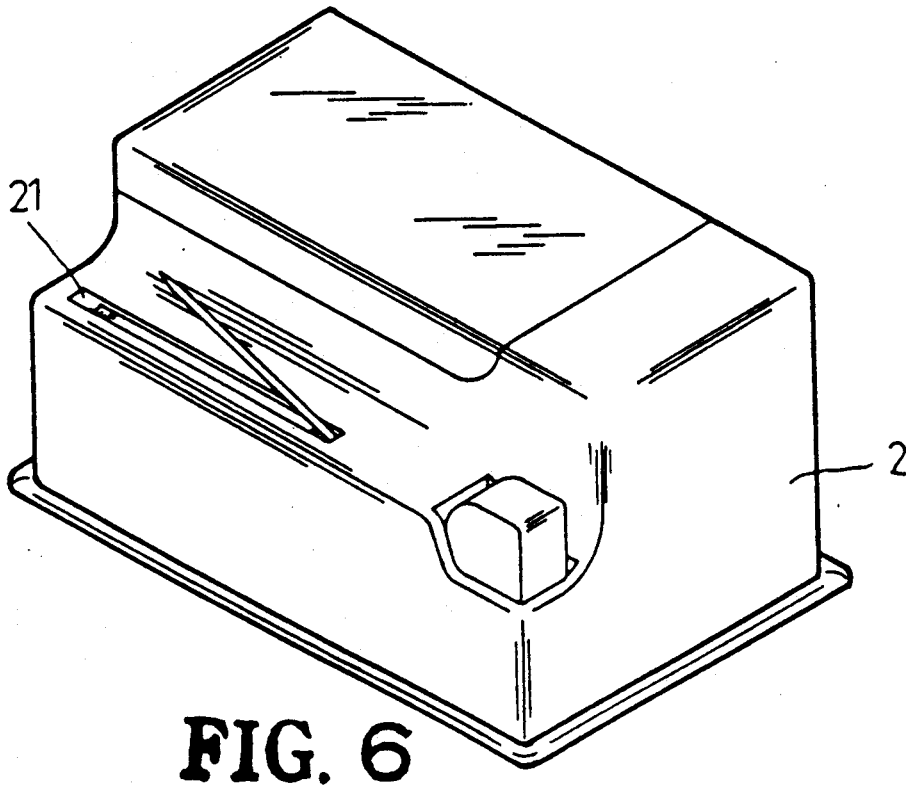
FIG. 6 is a perspective view showing a tooth-pick located in a dispensing position.

In operation, as shown in FIGS. 5 and 6, when the stud 56 is pressed with a finger tip by overcoming a biasing force of the coil spring 6, the oscillation member 5 is swung counterclockwise from its horizontal dispensing position to a lower position where the actuating plate 52 is withdrawn from the transverse slot 42 and the longitudinal projections 50, 51 are withdrawn from the slots 40, 41 of the floor-like member 4 thus allowing tooth-picks stacked in the tooth-pick chamber 8 to move frontwardly along the inclined surface of the floor-like member 4 and feed one tooth-pick at a time into the transverse groove 43.

When the finger is released from the stud 56, the biased coil spring 6 automatically retracts the oscillation member 5 into its dispensing position where the actuating plate 52 extends through the transverse slot 42 and the top surface of the actuating plate 52 carries the tooth-pick loaded in the groove 43 to exterior of the housing 2 through the delivery opening 21. An arcuate portion 520 of the actuating plate 52 locates the tooth-pick in a dispensing position, as best shown in FIG. 6.

I claim:

1. A tooth-pick dispenser comprising:

a housing having a first chamber for loading tooth-picks, confined by two pairs of opposed vertical side walls and having an open top in a major and rear portion of a top of the housing, a transverse delivery opening formed in a front portion of the top of the housing beyond the open top of the first chamber, a corner opening and an open bottom;

a lid for closing the open top of the first chamber; a floor-like member disposed in the housing under the first chamber to serve as a bottom of the first chamber and having a transverse groove formed with a transverse opening vertically in alignment with the delivery opening of the housing and two spaced-apart slots extending longitudinally;

an oscillation member having a bent front end with an upper plate dimensioned to extend through the aligned transverse openings in the floor-like member and top of the housing, two spaced-apart longitudinal projection adapted to extend through the longitudinal slots in the floor-like member, an up-raised stud in the bent front end being dimensioned to extend through the corner opening in top of the housing and an axle end spaced from the bent end, being formed with an axle for mounting the oscillation member rotatable about the axle between a substantially horizontal dispensing position where the up-raised plate extends through the aligned transverse openings in the floor-like member and top of the housing, the stud extends through the corner opening in top of the housing and protrudes upwardly therefrom, and the longitudinal projections extend through respective longitudinal slots in the floor-like member and protrude therefrom and a lower inclined position where the up-raised plate and longitudinal projections are withdrawn from respective openings or slots by pressing the stud with a finger tip;

a base plate for closing the open bottom of the housing;

first support means mounted on the base plate in a spaced-apart relation for retaining the axle of the oscillation member in position;

second support means mounted on the base plate in a spaced-apart relation for supporting the floor-like member in position where the floor-like member inclines longitudinally; and fittings for securing the base plate to the housing and retaining the first and second support means in position.

* * * * *